US010010124B2

(12) United States Patent
Kishihara

(10) Patent No.: US 10,010,124 B2
(45) Date of Patent: Jul. 3, 2018

(54) GLOVE AND MANUFACTURING METHOD OF GLOVE

(71) Applicant: SHOWA GLOVE CO., Hyogo (JP)

(72) Inventor: Hidetoshi Kishihara, Hyogo (JP)

(73) Assignee: Showa Glove Co., Hyogo (JP)

( * ) Notice: Subject to any disclaimer, the term of this patent is extended or adjusted under 35 U.S.C. 154(b) by 40 days.

(21) Appl. No.: 15/084,941

(22) Filed: Mar. 30, 2016

(65) Prior Publication Data

US 2016/0286874 A1 Oct. 6, 2016

(30) Foreign Application Priority Data

Apr. 1, 2015 (JP) ..... 2015-075124

(51) Int. Cl.
*A41D 19/015* (2006.01)
*A41D 19/00* (2006.01)

(52) U.S. Cl.
CPC ..... *A41D 19/0006* (2013.01); *A41D 2500/10* (2013.01)

(58) Field of Classification Search
CPC .. A41D 19/015; A41D 2400/22; A41D 19/02; A41D 2300/50; A41D 19/0006; A41D 19/00; A41D 19/0058; A41D 19/0065; A41D 19/0082; A41D 19/01505; A41D 19/01558; A41D 2300/52; A41D 2500/10; A41D 2500/54; A41D 31/0061; A41D 19/01529; A41D 19/01576; A61B 42/00; B29C 41/14; B29C 59/02; B29D 99/0067
See application file for complete search history.

(56) References Cited

U.S. PATENT DOCUMENTS

| | | | | |
|---|---|---|---|---|
| 4,918,754 | A | 4/1990 | Leatherman et al. | |
| 8,695,120 | B2 * | 4/2014 | Green | A41D 19/015 2/159 |
| 9,526,282 | B2 * | 12/2016 | Green | A41D 19/015 |
| 2006/0129079 | A1 * | 6/2006 | Outred | A61F 5/0118 602/21 |

(Continued)

FOREIGN PATENT DOCUMENTS

| | | |
|---|---|---|
| DE | 298 19 644 | 4/2000 |
| GB | 2466348 A | 6/2010 |

(Continued)

*Primary Examiner* — Bobby Muromoto, Jr.
(74) *Attorney, Agent, or Firm* — Norris McLaughlin & Marcus, P.A.

(57) ABSTRACT

A glove includes: an inner glove knitted from a fiber yarn; an outer glove that covers an outer side of the inner glove; and a hot-melt adhesive interposed partially between the inner glove and the outer glove which are layered, the outer glove including: a base knitted from a fiber yarn; and a coating layer layered on an outer face of the base and composed of a rubber or resin as a principal component; and the inner glove and the outer glove are bonded together by first heating the hot-melt adhesive applied onto a bonding portion on the inner glove or the outer glove, and then cooling and pressurizing the bonding portion. The inner glove is preferably a knitted product. The inner glove is preferably seamless. The cooling temperature during the cooling and pressurizing is preferably no higher than a softening point of the hot-melt adhesive.

8 Claims, 4 Drawing Sheets

(56) References Cited

U.S. PATENT DOCUMENTS

| | | | | |
|---|---|---|---|---|
| 2006/0150300 | A1* | 7/2006 | Hassan | A41D 19/0058 2/161.6 |
| 2010/0037362 | A1* | 2/2010 | Green | A41D 19/015 2/161.1 |
| 2010/0154099 | A1* | 6/2010 | Lee | A41D 19/0006 2/164 |
| 2010/0186141 | A1* | 7/2010 | Green | A41D 19/015 2/161.1 |
| 2011/0265245 | A1* | 11/2011 | Asiaghi | G06F 3/014 2/167 |
| 2012/0317693 | A1* | 12/2012 | Hatz | A41D 19/01582 2/16 |
| 2013/0180028 | A1* | 7/2013 | Kishihara | A41D 19/0065 2/168 |
| 2014/0041096 | A1* | 2/2014 | Takahashi | A41D 19/01558 2/168 |
| 2016/0029721 | A1* | 2/2016 | Sheehy | A41D 19/01505 2/16 |

FOREIGN PATENT DOCUMENTS

| | | |
|---|---|---|
| JP | 2008-514467 | 5/2008 |
| JP | 2010-047870 | 3/2010 |
| WO | WO-2006/039131 | 4/2006 |

* cited by examiner ( a )

( b )

GLOVE AND MANUFACTURING METHOD OF GLOVE

TECHNICAL FIELD

The present invention relates to a glove and a manufacturing method of a glove.

BACKGROUND OF THE INVENTION

As a glove used in construction works and operations in cold regions, a glove comprising an inner glove knitted from a fiber yarn and an outer glove covering an outer side of the inner glove and provided with a coating composed of a rubber or a resin as a principal component has been known.

In this conventional glove, the inner glove and the outer glove are bonded together by a hot-melt adhesive. As a bonding method, a method of: putting an inner glove with a hot-melt adhesive applied thereon onto a metallic hand model provided with a heater; putting the outer glove thereonto; and heating the hot-melt adhesive in a state in which the inner glove and the outer glove are in close contact while air therebetween is suctioned, has been known (refer to Japanese Unexamined Patent Application, Publication No. 2010-47870). This method may often allow the hot-melt adhesive to reach an interior surface of the inner glove and the above-described conventional glove may often give an unpleasant sensation such as roughness to a user during wearing.

As another bonding method, a method of: providing an outer glove composed of a rubber or a resin on a hand model; applying and drying a hot-melt adhesive; putting an inner glove composed of fiber thereonto; bringing the outer glove, the adhesive, and the inner glove into close contact with each other by inflation with an air pressure from inside; and bonding by melting the adhesive, has been known (Japanese Unexamined Patent Application Publication (Translation of PCT Application) No. 2008-514467). However, in this method it is difficult to uniformly pressurizing an entire glove having a complicated shape and bonding strength may be uneven. In addition, the glove may often be deformed due to heating and inflation of the outer glove. Peel strength of the above-described conventional glove may be insufficient due to uneven bonding strength and deformation of the covering glove.

PRIOR ART DOCUMENTS

Patent Document 1: Japanese Unexamined Patent Application Publication No. 2010-47870

Patent Document 2: Japanese Unexamined Patent Application Publication (Translation of PCT Application) No. 2008-514467

SUMMARY OF THE INVENTION

The present invention was made in view of such circumstances and has an objective of providing a glove with little unpleasant sensation such as roughness and superior peeling strength.

The invention which has been made to solve the above-described problems is a glove comprising: an inner glove that is knitted from a fiber yarn; an outer glove that covers an outer side of the inner glove; and a hot-melt adhesive that is interposed partially between the inner glove and the outer glove which are layered, characterized in that: the outer glove comprises a base that is knitted from a fiber yarn and a coating layer that is layered on an outer face of the base and composed of a rubber or a resin as a principal component; and the inner glove and the outer glove are bonded together by first heating the hot-melt adhesive applied onto a bonding portion on the inner glove or the outer glove and then cooling and pressurizing the bonding portion.

According to the glove, the hot-melt adhesive applied to the bonding portion on the inner glove or the outer glove is heated, and then the bonding portion is cooled and pressurized to bond the inner glove and the outer glove together. In the glove, the hot-melt adhesive is impregnated into the inner glove and the outer glove as a result of the pressurization, to thereby firmly bond the inner glove and the outer glove together with the hot-melt adhesive. Meanwhile, the hot-melt adhesive is quickly solidified as a result of the cooling, to thereby prevent the hot-melt adhesive from reaching the interior surface of the inner glove. In addition, unlike Patent Document 2, the glove does not require inflation of the outer glove upon heating for bonding the inner glove and the outer glove together. This can inhibit unevenness of bonding strength and deformation of the outer glove. Consequently, the glove is less likely to give unpleasant sensation such as roughness to a user during wearing, and is superior in peeling strength.

It is preferred that the inner glove is a knitted product. A knitted product has a relatively large area of air-space between yarns. Even in the case of such a knitted product with a large area of air-space being used as the inner glove, the hot-melt adhesive can be prevented from reaching the interior surface of the inner glove by cooling and pressurizing the bonding portion between the inner glove and the outer glove. Consequently, by employing an inner glove which is a knitted product, the unpleasant sensation given to the user during wearing of the glove can further be inhibited.

It is preferred that the inner glove is seamless. Since a seamless glove does not have a seam, causing less friction with hand skin and giving less unpleasant sensation. In addition, the seamless inner glove improves adherence in the bonding portion between the inner glove and the outer glove, to thereby improve peeling strength.

It is preferred that a cooling temperature during the cooling and pressurizing of the bonding portion is no higher than a softening point of the hot-melt adhesive. By setting the cooling temperature during the cooling and pressurizing of the bonding portion within the above specified range, the hot-melt adhesive can be prevented more infallibly from reaching the interior surface of the inner glove.

It is preferred that a pressure applied during the cooling and pressurizing of the bonding portion is at least 0.15 $g/mm^2$ and no greater than 1.1 $g/mm^2$. By setting the pressure applied during the cooling and pressurizing of the bonding portion within the above specified range, the bonding strength between the inner glove and the outer glove, and an effect of preventing the hot-melt adhesive from reaching the interior surface of the inner glove can be improved easily and infallibly.

It is preferred that the bonding portion is provided in fingertip regions on a palm side of first to fifth fingers and in at least one of border regions between a palm and the first to fifth fingers. By thus providing the bonding portion in the above specified region(s), misalignment of the inner glove and the outer glove at an interface thereof, upon wearing and removing the glove and gripping an object, can be inhibited.

Another invention which has been made to solve the above-described problems is a glove comprising: an inner glove that is knitted from a fiber yarn; an outer glove that covers an outer side of the inner glove; and a hot-melt adhesive that is interposed partially between the inner glove and the outer glove which are layered, characterized in that the hot-melt adhesive has impregnated into the inner glove, without reaching an interior surface of the inner glove.

In the glove, the hot-melt adhesive has impregnated into the inner glove, and the inner glove and the outer glove are firmly bonded together through the hot-melt adhesive. In addition, in the glove, the hot-melt adhesive has not reached the interior surface of the inner glove. Consequently, the glove can suppress the unpleasant sensation such as roughness given to the user during wearing of the glove and is superior in peeling strength.

Another invention which has been made to solve the above-described problems is a manufacturing method of a glove which comprises an inner glove that is knitted from a fiber yarn, an outer glove that covers an outer side of the inner glove, and a hot-melt adhesive that is interposed partially between the inner glove and the outer glove which are layered, the outer glove comprising a base that is knitted from a fiber yarn and a coating layer that is layered on an outer face of the base and composed of a rubber or a resin as a principal component, the manufacturing method including:

an application step of applying the hot-melt adhesive onto a bonding portion on an outer face of the inner glove; a covering step of covering with the outer glove an outer face of the inner glove following the application step; a heating step of heating the hot-melt adhesive after the covering step; and a step of cooling and pressurizing the bonding portion of the inner glove and the outer glove after the heating step.

In the manufacturing method of a glove, the hot-melt adhesive applied to the bonding portion on the inner glove or the outer glove is heated, and then the bonding portion is cooled and pressurized. Consequently, in the manufacturing method of a glove, the hot-melt adhesive is impregnated into the inner glove and the outer glove as a result of the pressurization, to thereby allow firm bonding between the inner glove and the outer glove by way of the hot-melt adhesive. Meanwhile, in the manufacturing method of a glove, the hot-melt adhesive is quickly solidified as a result of the cooling, to thereby prevent the hot-melt adhesive from reaching the interior surface of the inner glove. In addition, unlike Patent Document 2, the manufacturing method of a glove does not require inflation of the outer glove upon heating for bonding the inner glove and the outer glove together. This can inhibit unevenness of bonding strength between the inner glove and the outer glove, as well as deformation of the outer glove. Consequently, the manufacturing method of a glove enables a glove which is less likely to give unpleasant sensation such as roughness to a user during wearing, and is superior in peeling strength to be manufactured.

As used herein, the term "principal component" indicates a component having the largest content, for example a component having a content of at least 50% by mass. The term "seamless" indicates a way of knitting a glove only with stitches, without a seam. The term "softening point" indicates a temperature at which a solid substance starts softening and deformation by heating, and is measured in conformity to JIS-K-6863 (1994). The term "fingertip regions" indicates a region closer to a fingertip than the position of the first joint when a glove is worn. In addition, the term "at least one of border regions between a palm and the first to fifth fingers" indicates a vicinity of a base of at least one of the first to fifth fingers on a palm side of a glove. Furthermore, the term "cooling temperature" indicates a surface temperature of a pressure plate for pressurizing the bonding portion in the cooling and pressurizing step. Moreover, the term "impregnate" indicates a state in which an adhesive or the like is contained inside a target (inner glove and outer glove), and "reach" indicates a state in which the adhesive or the like has passed through and infiltrates thereinto from the target.

As described above, the present invention can provide a glove with little unpleasant sensation such as roughness and superior peeling strength.

DESCRIPTION OF THE PREFERRED EMBODIMENTS

Hereafter, embodiments of the present invention are described in detail with reference to the Drawings as necessary.

Figure 1:
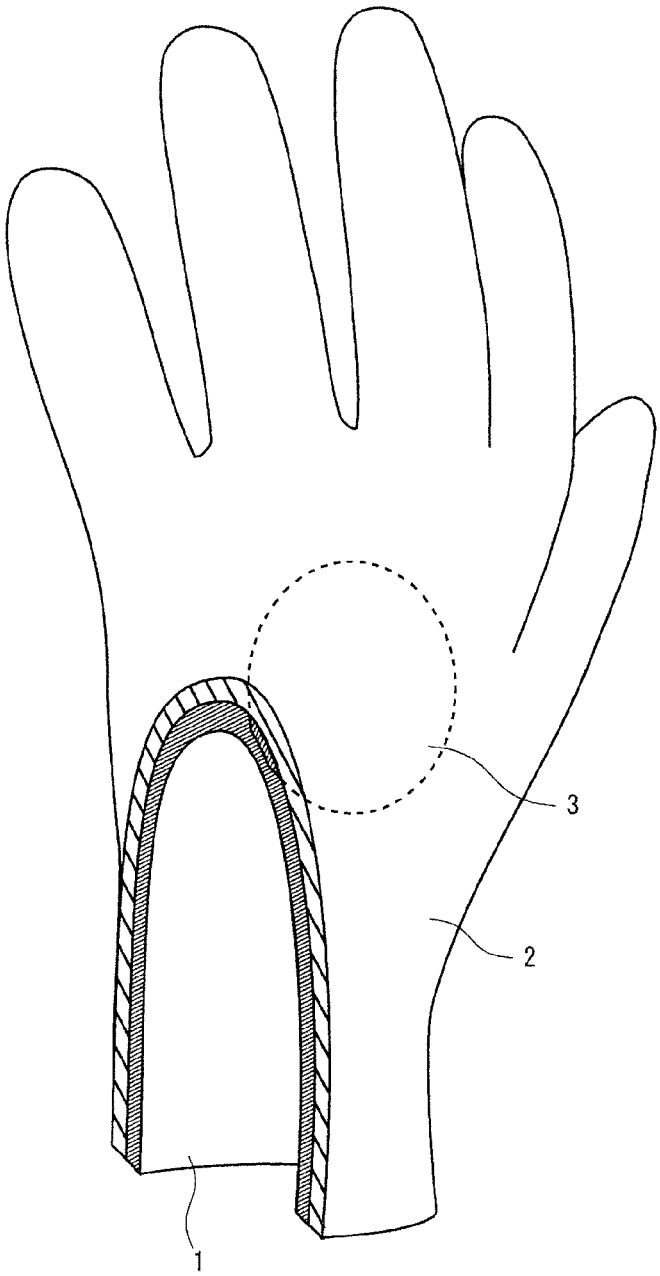
FIG. 1 is a partial cutout perspective view taken from a dorsal side of a glove according to an embodiment of the present invention.
Figure 2:
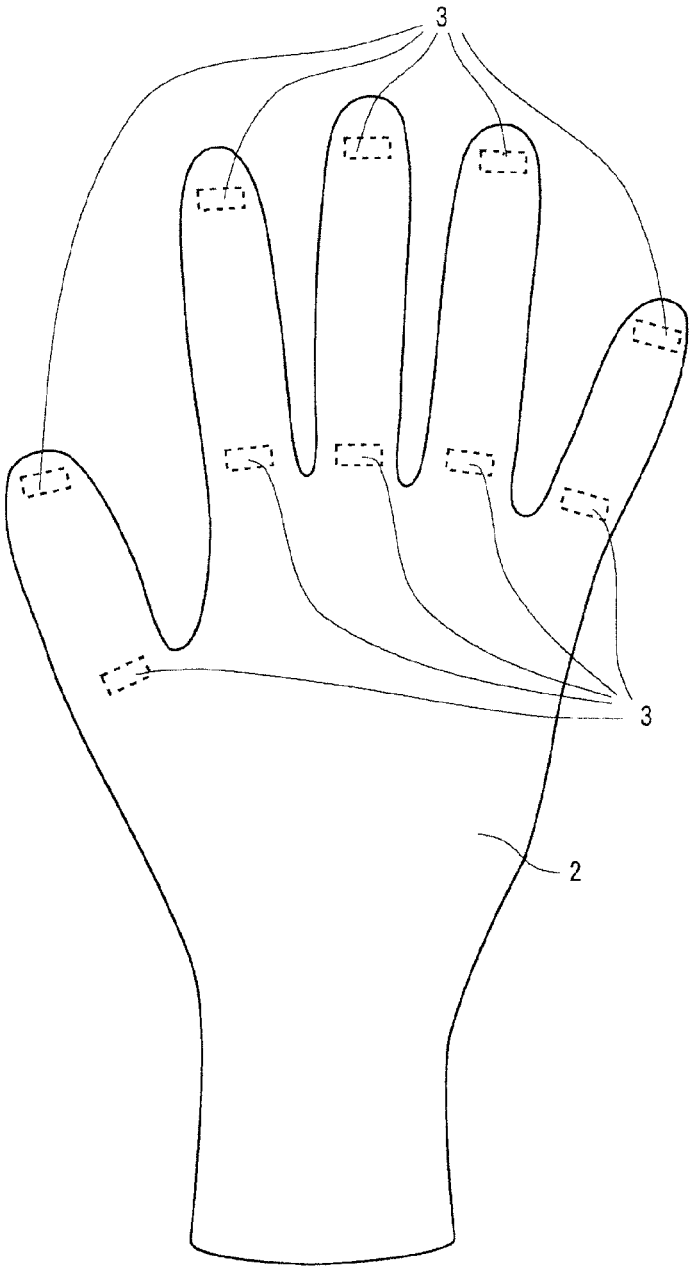
FIG. 2 is a perspective view taken from a palm side of the glove shown in FIG. 1.

A glove of the present embodiment comprises, as illustrated in FIGS. 1 and 2: an inner glove 1 that is knitted from a fiber yarn; an outer glove 2 that covers an outer side of the inner glove 1; and a hot-melt adhesive 3 that is interposed partially between the inner glove 1 and the outer glove 2 which are layered. According to the glove, the inner glove 1 and the outer glove 2 have been bonded together by first heating the hot-melt adhesive 3 applied onto a bonding portion on the inner glove 1 or the outer glove 2 and then cooling and pressurizing the bonding portion. Here, the hot-melt adhesive 3 has impregnated into the inner glove 1, without reaching an interior surface of the inner glove 1.

Inner Glove

The inner glove 1 is composed of a fiber yarn knitted in a glove shape. The inner glove 1 includes: a main body portion formed in a pouch-like shape to cover a dorsal side and a palm of a user's hand; an extending portion extending from the main body portion to cover user's fingers; a cylindrical cuff portion extending from the main body portion in an opposite direction from the extending portion to cover a user's wrist. The extending portion includes a first finger portion, a second finger portion, a third finger portion, a fourth finger portion, and a fifth finger portion that cover user's first finger (thumb), second finger (index finger), third finger (middle finger), fourth finger (ring finger), and fifth finger (pinky finger), respectively. The first to fifth finger portions are formed in cylindrical shapes with fingertip portions closed. In addition, the cuff portion has an opening through which the user can insert a hand.

The fiber composing the inner glove 1 is exemplified by: a natural fiber such as cotton and linen; a synthetic fiber such as a polyamide fiber, a polyester fiber, a polypropylene fiber, a rayon fiber, an acrylic fiber, an aramid fiber, a high-strength polyethylene fiber, a polyurethane fiber and a super high-strength polyethylene fiber; a metallic fiber such as stainless steel; an inorganic fiber such as a glass fiber; a conductive fiber; and the like. These fibers can be used alone or as a mixture of two or more. As fibers used as a mixture of two, a composite fiber in which a stainless fiber is covered with nylon or the like can be exemplified. The above-mentioned fiber is selected according to heat retention, thermal insulation, cut resistance properties, moisture retention, cushioning properties, and the like. For example, for achieving cut resistance properties, the metallic fiber can be selected. In addition, the above-mentioned fiber yarn is not particularly limited and spun yarn, crimped filament yarn, fancy yarn such as loop yarn and chenille yarn, straight yarn, and the like can be employed.

The inner glove 1 is a knitted product knitted from the fiber yarn. The knitted product has a relatively large area of air-spaces between yarns. Even in the case of using such a knitted product with a large area of air spaces as the inner glove, the present glove prevents the hot-melt adhesive 3 from reaching the interior surface of the inner glove 1. Given the above, by employing a knitted product as the inner glove 1, unpleasant sensation such as roughness given to the user during wearing of the glove can further be inhibited.

It is preferred that the inner glove 1 is seamless. Since a seamless glove does not have a seam, less friction with hand skin is caused and unpleasant sensation is less likely to be given. In addition, the seamless inner glove 1 improves adherence in the bonding portion between the inner glove 1 and the outer glove 2, to thereby improve peeling strength.

A knitting gauge of the inner glove 1 is not particularly limited as long as the inner glove 1 with appropriate strength and flexibility can be obtained. For example, in the case of knitting the inner glove 1 by a seamless knitting machine with nylon crimped yarn of at least 154 dtex and no greater than 1430 dtex, cotton yarn of 40 to 5 cotton count or the like, the knitting gauge is preferably at least 7 and no greater than 18. It should be noted that the term "knitting gauge" means the number of knitting needles held per 1 inch.

The lower limit of the average thickness of the inner glove 1 is preferably 0.3 mm and more preferably 0.4 mm. On the other hand, the upper limit of the average thickness of the inner glove 1 is preferably 4 mm and more preferably 3 mm. In the case of the average thickness of the inner glove 1 being smaller than the lower limit, the glove may lack strength and durability of the glove may be lowered. On the other hand, in the case of the average thickness of the inner glove 1 being greater than the upper limit, an increased thickness deteriorates flexibility of the glove and may reduce workability during wearing. Here, the average thickness of the inner glove 1 is an average of values measured by a constant pressure thickness gauge (e.g., PG-15 manufactured by TECLOCK Corporation, with 10 mm gauge head diameter and 240 gf pressure load (measuring force)), at 9 points equally marked on a grid of 3 rows by 3 columns in a region of 45 mm by 45 mm in a center part of a palm region of the glove.

Outer Glove

The outer glove 2 includes: a base 2*a* that is knitted from a fiber yarn in a glove shape; and a coating layer 2*b* that is layered on an outer face of the base 2*a* and composed of a rubber or a resin as a principal component. An interior surface of the base 2*a* constitutes an interior surface of the outer glove 2 and is partially bonded to the inner glove 1 by the hot-melt adhesive 3.

The base 2*a* has a similar shape to the inner glove 1 and can cover an outer side of the inner glove 1. As a fiber composing the base 2*a*, ones exemplified for the inner glove 1 can be used, and a fiber suitable for forming of the coating layer 2*b* can appropriately be selected. In addition, a knitting gauge and the average thickness of the base 2*a* can be configured similarly to those of the inner glove 1.

The coating layer 2*b* is composed of a rubber or a resin as a principal component. Examples of the rubber include natural rubbers, isoprene rubbers, acrylic rubbers, chloroprene rubbers, butyl rubbers, butadiene rubbers, fluorine rubbers, styrene-butadiene copolymers, acrylonitrile-butadiene rubbers, chlorosulfonated polyethylenes, epichlorohydrin rubbers, urethane rubbers, ethylene-propylene rubbers, silicone rubbers, and mixtures thereof. Among these, natural rubbers, isoprene rubbers, chloroprene rubbers, butadiene rubbers, styrene-butadiene copolymers, and acrylonitrile-butadiene rubbers are preferred, and natural rubbers and acrylonitrile-butadiene rubbers are particularly preferred from the viewpoint of cost, processability, elasticity, durability, weather resistance, etc. In addition, examples of the resin include polyvinyl chloride, polyurethane, polyvinylidene chloride, polyvinyl alcohol, chlorinated polyethylene, ethylene-vinyl alcohol copolymers, vinyl chloride-vinyl acetate copolymers, and mixtures thereof. Among these, polyvinyl chloride and polyurethane are preferred, and polyvinyl chloride is particularly preferred from the viewpoint of processability.

It is preferred that the coating layer 2*b* has not reached an interior surface of the base 2*a*. With the coating layer 2*b* having not reached the interior surface of the base 2*a*, the hot-melt adhesive 3 is allowed to impregnate into the base 2*a* easily, to thereby increase the bonding strength between the inner glove 1 and the outer glove 2.

The lower limit of the average thickness of the coating layer 2*b* is preferably 50 μm and more preferably 80 μm. On the other hand, the upper limit of the average thickness of the coating layer 2*b* is preferably 2 mm and more preferably 1.5 mm. In the case of the average thickness of the coating layer 2*b* being smaller than the lower limit, the coating layer may lack strength. On the other hand, in the case of the average thickness of the coating layer 2*b* being greater than the upper limit, the glove may lack flexibility. Here, the average thickness of the coating layer 2*b* is an average of values measured at 10 positions at intervals of 2 mm in a center part of a palm region of the glove, for a distance between an innermost surface and an exterior surface of the coating layer 2*b*, by: making a cleavage of 20 mm at an angle of substantially 45° with respect to a longitudinal direction of fingers; and observing a cross-section of the cleavage by using a digital microscope (e.g., VHX-900 manufactured by Keyence Corporation).

It should be noted that various additives such as a softening agent and an antibacterial agent may be added to the inner glove 1 and the base 2*a* of the outer glove 2. Alternatively, the fiber of the inner glove 1 and the base 2*a* of the outer glove 2 may include a chemical agent having such functions blended thereinto. Furthermore, a well-known crosslinking agent, a vulcanization accelerator, an anti-aging agent, a thickener, a plasticizer, a pigment, a foaming agent, a foam stabilizer and/or the like can be added to the coating layer 2*b* of the outer glove 2.

Hot-melt Adhesive

The hot-melt adhesive 3 is partially interposed between the inner glove 1 and the outer glove 2 being layered, to thereby bond the inner glove 1 and the outer glove 2 together. A type of the hot-melt adhesive is not particularly limited, and polyethylene-vinyl acetate (EVA), polyolefin, polyurethane, a styrene-butadiene rubber (SBS), polyamide and the like can be exemplified.

Figure 3:
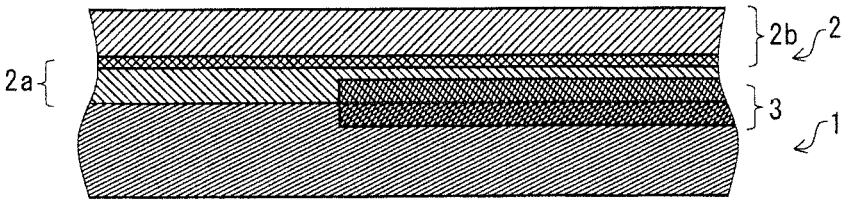
FIG. 3 is a schematic partial cross-sectional view of the glove shown in FIG. 1.

In the glove, the inner glove 1 and the outer glove 2 have been bonded together by first heating the hot-melt adhesive 3 applied onto a bonding portion on the inner glove 1 or the outer glove 2 and then cooling and pressurizing the bonding portion. Consequently, as illustrated in FIG. 3, the hot-melt adhesive 3 is impregnated into the inner glove 1 and the outer glove 2 as a result of pressurization to thereby firmly bond the inner glove 1 and the outer glove 2 together. Meanwhile, the hot-melt adhesive 3 is quickly solidified by cooling and thus prevented from reaching the interior surface of the inner glove 1.

The softening point of the hot-melt adhesive 3 is appropriately selected according to an upper temperature limit of the material composing the coating layer 2*b*. More specifically, the lower limit of the softening point of the hot-melt adhesive 3 is preferably 70° C. and more preferably 75° C. On the other hand, the upper limit of the softening point of the hot-melt adhesive 3 is preferably 140° C. and more preferably 120° C. In the case of the softening point of the hot-melt adhesive 3 being lower than the lower limit, the inner glove 1 and the outer glove 2 may separate from each other in a high temperature environment during transport or during gripping of a hot object. On the contrary, in the case of the softening point of the hot-melt adhesive 3 exceeding the upper limit, the coating layer 2*b* may be discolored by heat.

As illustrated in FIGS. 1 and 2, the glove has the bonding portions provided in: fingertip regions on a palm side of first to fifth fingers; border regions between a palm and the first to fifth fingers; and a central region on a dorsal side. In these regions the inner glove 1 and the outer glove 2 are likely to get misaligned during putting on and stripping off of the glove. Given this, bonding these regions can effectively prevent the misalignment. Among these, providing the bonding portion at a base of fingers, within the border regions between a palm and the first to fifth fingers, is particularly effective for prevention of the misalignment.

Meanwhile, the glove does not have the bonding portion in a central region on a palm side, and between the fingertip regions and the border region (hereinafter also referred to as "joint region of finger"). The central region on a palm side is greatly bent by the third joints of the fingers and subjected to complicated movements. The joint regions of fingers including the first and second joints are also subjected to complicated bending. In such regions subjected to complicated movements, stresses in different directions and of different strengths are respectively applied to the inner glove 1 and the outer glove 2. By not having the bonding region in the central region on the palm side and in the joint region of fingers, the glove can absorb the difference of stresses owing to a relative misalignment between the inner glove 1 and the outer glove 2. As a result, the resistance to bending due to the difference of stresses can be prevented, thereby improving flexibility of the glove.

Manufacturing Method of Glove

The manufacturing method of a glove includes an application step of applying the hot-melt adhesive 3 onto the bonding portion on an outer face of the inner glove 1; a covering step of covering an outer side of the inner glove 1 following the application step with the outer glove 2; a heating step of heating the hot-melt adhesive 3 after the covering step; a step of cooling and pressurizing the bonding portion of the inner glove 1 and the outer glove 2 after the heating step; and a step of sewing together the cuff portions of the inner glove 1 and the outer glove 2.

Application Step

In the application step, the inner glove 1 is put onto a flat model, and the hot-melt adhesive 3 is applied onto the bonding portion on the inner glove 1 and solidified. The bonding portion is provided in, as described above, the fingertip regions on a palm side of first to fifth fingers, the border regions between a palm and the first to fifth fingers, and the central region on a dorsal side.

An application procedure of the hot-melt adhesive 3 is not particularly limited, but can be the small amount-discharging method of applying in dots or linearly, or the spraying method of applying to a large area. In the case of the bonding portion being partially provided as in the present glove, the small amount-discharging method, which facilitates the application to particular regions, is preferred.

In the case of the bonding portion being provided partially on the inner glove 1 and the outer glove 2 as in the present glove, the lower limit of the application amount of the hot-melt adhesive 3 is preferably 0.05 mg/mm$^2$, and more preferably 0.1 mg/mm$^2$. On the other hand, the upper limit of the application amount of the hot-melt adhesive 3 is preferably 0.25 mg/mm$^2$, and more preferably 0.2 mg/mm$^2$. The application amount of the hot-melt adhesive 3 smaller than the lower limit may make the bonding strength between the inner glove 1 and the outer glove 2 insufficient. On the other hand, the application amount of the hot-melt adhesive 3 exceeding the upper limit may lower flexibility of the glove.

Covering Step

In the covering step, the outer glove 2 is put onto the inner glove 1 following the application step.

Heating Step

In the heating step, the glove is heated after the covering step to fluidize the hot-melt adhesive 3. By thus heating the glove after putting the outer glove 2, uneven application amount of the hot-melt adhesive 3 in the application step, and adhesion of the hot-melt adhesive 3 to a region other than the bonding portion designated for application can be inhibited.

The heating procedure is not particularly limited, and well-known heating procedures such as heat, microwaves, and high-frequency waves can be employed. The heating is preferably performed from an outer side of the outer glove 2. By thus performing heating from the outer side of the outer glove 2, the time period required for cooling and pressurizing can be reduced.

The temperature for the heating is preferably higher than the softening point of the hot-melt adhesive 3 by at least 20° C. and no greater than 100° C. More specifically, the lower limit of the heating temperature can be any temperature at which the hot-melt adhesive 3 is fluidized; preferably 90° C. and more preferably 100° C. On the other hand, the upper limit of the heating temperature is preferably 180° C. and more preferably 160° C. The heating temperature lower than the lower limit may allow the hot-melt adhesive 3 to solidify before having sufficiently impregnated into the inner glove 1 and the outer glove 2 in the step of cooling and pressurizing, and may make the bonding strength between the inner glove 1 and the outer glove 2 insufficient. On the contrary, the heating strength exceeding the upper limit may discolor the coating layer 2*b* of the outer glove 2.

The time period of the heating is not limited as long as sufficient fluidization of the hot-melt adhesive 3 is executed, and is for example at least 3 seconds and no longer than 10 minutes.

In addition, in the heating step, heating is preferably performed without pressurizing. Pressurizing upon heating may facilitate the hot-melt adhesive 3 to move toward the interior surface of the inner glove 1 and reduce the amount of the hot-melt adhesive 3 interposed between the inner glove 1 and the outer glove 2, whereby the peeling strength may be reduced. In addition, this may allow the fluidized hot-melt adhesive 3 to reach the interior surface of the inner glove 1, leading to the unpleasant sensation such as roughness when the user wears the glove.

Cooling and Pressurizing Step

In the cooling and pressurizing step, the bonding portion between the inner glove 1 and the outer glove 2 is cooled and pressurized after the heating step, to thereby bond the inner glove 1 and the outer glove 2 together.

The lower limit of the cooling temperature for cooling and pressurizing the bonding portion is preferably 4° C. and more preferably 5° C. On the other hand, the upper limit of the cooling temperature is preferably a softening point of the hot-melt adhesive, more preferably 35° C., and further more preferably 30° C. The cooling temperature lower than the lower limit may cause dew condensation on a pressure plate for pressurizing the bonding portion, and dew condensation water may attach to the glove, leading to molding on the glove. On the contrary, the cooling temperature exceeding the upper limit increases the solidifying time period for bonding the inner glove 1 and the outer glove 2 together, and may fail to sufficiently prevent the hot-melt adhesive 3 from reaching the interior surface of the inner glove 1.

The lower limit of the pressure applied for cooling and pressurizing the bonding portion is preferably 0.15 g/mm$^2$ and more preferably 0.2 g/mm$^2$. On the other hand, the upper limit of the pressure is preferably 1.1 g/mm$^2$ and more preferably 0.8 g/mm$^2$. The pressure less than the lower limit does not allow the hot-melt adhesive 3 to sufficiently impregnate into the inner glove 1 and may make the bonding strength between the inner glove 1 and the outer glove 2 insufficient. On the contrary, the pressure greater than the upper limit may fail to sufficiently prevent the hot-melt adhesive 3 from reaching the interior surface of the inner glove 1. By setting the pressure to fall within the above specified range, the bonding strength between the inner glove 1 and the outer glove 2, and reach of the hot-melt adhesive 3 to the interior surface of the inner glove 1 can be controlled easily and infallibly.

The time period of cooling and pressurizing is appropriately selected according to the cooling temperature and the like. The lower limit of the time period of the cooling and pressurizing is, for example, 60 seconds for the cooling temperature of 30° C., 30 seconds for the cooling temperature of 20° C., 15 seconds for the cooling temperature of 10° C., etc. On the other hand, the upper limit of the time period of the cooling and pressurizing can be, for example, 5 minutes. The time period of the cooling and pressurizing shorter than the lower limit may lead to a failure to sufficiently solidify the hot-melt adhesive 3. On the contrary, the time period of the cooling and pressurizing exceeding the upper limit is unnecessarily long and may lead to lowered productivity of the glove.

Sewing Step

In the sewing step, the glove following the cooling and pressurizing step is removed from the flat model and the inner glove 1 and the outer glove 2 are unified by sewing at the cuff portion. The glove can thus be manufactured.

Advantages

According to the glove, the inner glove 1 and the outer glove 2 have been bonded together by first heating the hot-melt adhesive 3 applied onto a bonding portion on the inner glove 1 or the outer glove 2 and then cooling and pressurizing the bonding portion. In the glove, the hot-melt adhesive 3 has impregnated into the inner glove 1 and the outer glove 2 as a result of the pressurization, and the inner glove 1 and the outer glove 2 are firmly bonded together through the hot-melt adhesive 3. Meanwhile, the hot-melt adhesive 3 is quickly solidified by cooling and thus prevented from reaching the interior surface of the inner glove 1. In addition, unlike Patent Document 2, inflation of the outer glove 2 is not required upon heating for bonding the inner glove 1 and the outer glove 2 together. This can inhibit unevenness of bonding strength, as well as deformation of the outer glove 2. Consequently, the glove is less likely to give unpleasant sensation such as roughness to a user during wearing, and is superior in peeling strength.

Other Embodiments

The present invention is not limited to the above-described embodiment, and can also be carried out in modes modified and improved in various ways, as well as the foregoing modes.

In the above-described embodiment, the case of the inner glove for the glove being a knitted product has been explained; however, a glove which is formed by cutting out woven fabric or nonwoven fabric in a glove shape and sewing can also be used.

In the above-described embodiment, the glove having the bonding portion in the fingertip regions on a palm side of first to fifth fingers, the border regions between a palm and the first to fifth fingers, and the central region on a dorsal side has been explained; however, the glove can also have the bonding portion in other regions. In addition, providing the bonding portion in all of the border regions between the palm and the fingers is not required, and it is possible to bond, for example, only a border region between the palm and the third finger regions, among the border regions. Furthermore, in the above-described embodiment, the glove not having the bonding portion in the central region on a palm side and in the joint regions of fingers has been explained; however, a glove having the bonding portion also in these regions, for example a glove with an adhesive entirely applied thereto is also within a scope of the present invention.

In a case of applying the adhesive to the entire glove, an application procedure is preferably the spraying method. The spraying method, which can easily enlarge an area of the bonding portion, is suitable for application to the entire glove. In addition, the spraying method allows thin application of the hot-melt adhesive in a net-like shape more easily, compared to the small-amount discharging method, and can easily ensure the flexibility and air permeability of the glove.

In a case of applying the adhesive to the entire glove, the lower limit of the application amount of the hot-melt adhesive is preferably 0.02 mg/mm$^2$ and more preferably 0.05 mg/mm$^2$. On the other hand, the upper limit of the application amount of the hot-melt adhesive is preferably 0.15 mg/mm$^2$ and more preferably 0.1 mg/mm$^2$. The application amount of the hot-melt adhesive smaller than the lower limit may make the bonding strength between the inner glove and the outer glove insufficient. On the contrary, the application amount of the hot-melt adhesive exceeding the upper limit may reduce the flexibility of the glove.

In the above-described embodiment, a case of the manufacturing method of the glove including the sewing step has been explained; however, the step is not necessary. For example, in the application step, the hot-melt adhesive can be applied to the cuff portions of the inner glove and the outer glove, and the inner glove and the outer glove can be unified by the hot-melt adhesive through the heating step and the cooling and pressurizing step.

EXAMPLES

Hereafter, the present invention is described in further detail by way of Examples and Comparative Examples; however, the present invention is not limited to the following Examples.

Formation of Outer Glove

A seamless glove of 13 knitting gauge and having an average thickness of 0.67 mm was formed as the base for the outer glove, by knitting a yarn of 308 dtex in total thickness composed of two pieces of wooly nylon two-fold yarn (two pieces of 24 in filament number and 77 dtex in the thickness per yarn). The seamless glove was put onto a metallic hand model, dipped in a coagulation liquid prepared by dissolving 0.7 parts by mass of calcium nitrate in 100 parts by mass of methanol, and withdrawn therefrom. Thereafter, the seamless glove thus withdrawn was dipped in a compound having a composition shown in Table 1. It should be noted that the compound used was prepared such that a solid content concentration of NBR latex was about 40%. After withdrawing the seamless glove thus dipped in the compound, curing was performed at 75° C. for 60 minutes and then at 130° C. for 30 minutes. The coating layer composed of a rubber as a principal component was thus formed on an exterior surface of the seamless glove. Finally, the seamless glove with the coating layer thus formed was washed with water and dried at 75° C. for 60 minutes to obtain the outer glove.

TABLE 1

| Compounding Agent | Manufacturer | Model | Number of parts added (parts by mass) |
|---|---|---|---|
| NBR Latex | Zeon Corporation | Lx550 | 100 |
| Vulcanizing Agent | Kanto Chemical Co., Inc. | Sulfur | 2.0 |
| Metal Oxide | Kanto Chemical Co., Inc. | Zinc Oxide | 1.0 |
| Vulcanizing Accelerator | Ouchi Shinko Chemical Industrial Co., Ltd. | BZ | 0.5 |
| Anti-aging Agent | LANXESS | BKF | 0.5 |
| Thickener | Toagosel Co., Ltd. | A-7075 | 0.2 |

Note)
Number of parts added is based on 100 parts by mass of NBR latex in terms of solid content Formation of Inner Glove A seamless glove of 10 knitting gauge and having an average thickness of 1.1 mm was formed by knitting a loop yarn 1/11 (with core yarn of wooly nylon of 110 dtex, press yarn of wooly nylon of 77 dtex; and acrylic floating yarn) to obtain the inner glove.

Example 1

First, the inner glove was put onto a metallic flat model; and a hot-melt adhesive (Hotstick HB-200S-1K manufactured by Taiyo Electric Ind. Co., Ltd., EVA, softening point: 80° C.) was applied to: the fingertip regions on a palm side; a base of fingers which is a part of border regions between a palm and the first to fifth fingers; and a central region on a dorsal side, at an application rate of 0.13 mg/mm$^2$ by the small-amount discharging method using a hot-melt gun. After solidifying of the hot-melt adhesive thus applied, the outer glove was put onto the inner glove. Thereafter, the hot-melt adhesive was heated at 150° C. for 4.5 minutes without pressurization to permit fluidization. Furthermore, the bonding portion between the inner glove and the outer glove where the hot-melt adhesive was present was pressed against an iron plate of 5° C. in surface temperature to cool, while pressurizing at a pressure of 0.53 g/mm$^2$ for 3 minutes from the exterior surface of the outer glove, and then the glove was removed from the model. Finally, cuffs of the inner glove and the outer glove were unified by cover stitching to obtain the glove of Example 1.

Examples 2 and 3

Gloves of Examples 2 and 3 were obtained in a similar way to Example 1, except for setting the pressure upon cooling and pressurizing to 0.26 g/mm$^2$ and 1.06 g/mm$^2$ respectively.

Example 4

A glove of Example 4 was obtained in a similar way to Example 1, except for setting the application amount of the hot-melt adhesive to 0.18 mg/mm$^2$ and heating the hot-melt adhesive while pressurizing at a pressure of 0.26 g/mm$^2$.

Comparative Example 1

First, the inner glove was put onto a metallic flat model; and a hot-melt adhesive (Hotstick HB-200S-1K manufactured by Taiyo Electric Ind. Co., Ltd., EVA, softening point: 80° C.) was applied to: the fingertip regions on a palm side; a base of fingers which is a part of border regions between a palm and the first to fifth fingers; and a central region on a dorsal side, at an application rate of 0.13 mg/mm$^2$ by the small-amount discharging method using a hot-melt gun. After solidifying of the hot-melt adhesive thus applied, the outer glove was put onto the inner glove. Thereafter, the hot-melt adhesive was heated at 150° C. for 4.5 minutes while pressurizing at a pressure of 0.53 g/mm$^2$ to permit fluidization. Furthermore, the glove was naturally cooled without pressurization at room temperature of 25° C. for 3 minutes and then removed from the model. Finally, cuffs of the inner glove and the outer glove were unified by cover stitching to obtain the glove of Comparative Example 1.

Comparative Examples 2 and 3

Gloves of Comparative Examples 2 and 3 were obtained in a similar way to Comparative Example 1, except for setting the pressure upon heating to 0.26 g/mm$^2$ and 1.06 g/mm$^2$ respectively.

Evaluations

Figure 4:
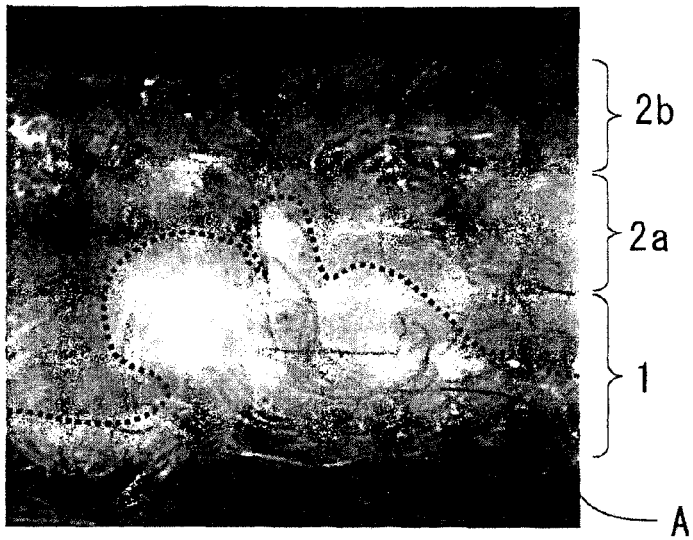
FIG. 4 shows photographs of cross-sections of gloves of (a) Example 1 and (b) Comparative Example 1.
Figure 4:
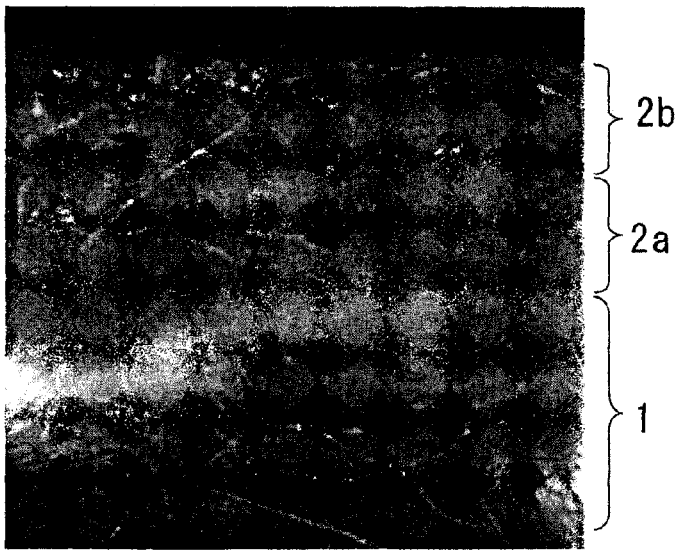

Examples 1 to 4 and Comparative Examples 1 to 3 were evaluated for the peeling strength and unpleasant sensation in gloves. Results are shown in Table 2. In addition, Example 1 and Comparative Example 1 were observed on cross sections and were evaluated for smoothness of the interior surfaces of gloves. Results are shown in FIG. 4 and Table 2.

Peeling Strength

Test pieces of 25 mm×60 mm including the bonding portions in the fingertip regions were cut out from an index finger part, a middle finger part, and a ring finger part of the glove. Using the test pieces, a peeling strength test was conducted at a pulling rate of 50 mm/min and a travel distance of 100 mm to determine as the peeling strength, a protruding point-average test force at the bonding portion. It should be noted that the peeling strength of at least 15 N is judged to be superior. As used herein, the "protruding point-average test force" is a value obtained by averaging test force of all protruding points within a data processing range for test force.

Unpleasant Sensation

Each of 10 testers wore 10 gloves and evaluated whether they got unpleasant sensation such as roughness from the interior surface of the gloves due to protrusion of the hot-melt adhesive, on the following scale of A to C and evaluation results were averaged. The evaluation closer to A shows less unpleasant sensation from the glove.

Evaluation Criteria for Unpleasant Sensation

A: no glove giving unpleasant sensation;

B: less than 5 gloves giving unpleasant sensation and no glove giving extreme discomfort; and C: 5 or more gloves giving unpleasant sensation, or a glove giving extreme discomfort Cross Section Observation The cross sections of the bonding portions of the fingertip regions of the glove were observed by using a digital microscope VHX-900 manufactured by Keyence Corporation. This observation allows determination of reaching of the hot-melt adhesive to the interior surface of the glove.

Smoothness

Test pieces of 25 mm×60 mm including the bonding portions in the fingertip regions were cut out from an index finger part, a middle finger part, and a ring finger part of the glove. Mean deviation (MMD) of average friction coefficient of the test pieces was measured by using a friction tester KES-SE-STP manufactured by Kato Tech Co., Ltd. A lower MMD indicates smoother interior surface of glove, with less roughness.

TABLE 2

| | Pressure | | | | |
|---|---|---|---|---|---|
| | Upon Heating ($g/mm^2$) | Upon Cooling ($g/mm^2$) | Peeling Strength (N) | Unpleasant Sensation | MMD |
| Example 1 | — | 0.53 | 27.4 | A | 0.00947 |
| Example 2 | — | 0.26 | 24.9 | A | — |
| Example 3 | — | 1.06 | 18.9 | A | — |
| Example 4 | 0.26 | 0.53 | 17.8 | B | — |
| Comparative Example 1 | 0.53 | — | 14.0 | B | 0.0194 |
| Comparative Example 2 | 0.26 | — | 14.3 | B | — |
| Comparative Example 3 | 1.06 | — | 14.8 | C | — |

It should be noted that "-" in the "Pressure" column in Table 2 means the absence of the pressurization. "-" in the "MMD" column means the measurement not conducted.

The results in Table 2 show that the gloves of Examples 1 to 4 had a greater peeling strength and superior evaluations with regard to unpleasant sensation than the gloves of Comparative Examples 1 to 3. In addition, the glove of Example 1 had superior MMD and less roughness than the glove of Comparative Example 1. Accordingly, it is revealed that a glove which gives little unpleasant sensation and is superior in peeling strength can be obtained by heating the hot-melt adhesive applied to the bonding portion of the inner glove and then cooling and pressurizing the bonding portion to thereby bond the inner glove and the outer glove together.

With reference to the photograph of the cross-section of the glove of Example 1 shown in FIG. 4 (*a*), a region A, which has higher whiteness than other parts of the inner glove 1, is present on the interior surface side of the inner glove 1. The region A is a region into which the adhesive has not entered, and other regions are regions into which the adhesive has entered. In other words, in the glove of Example 1, the hot-melt adhesive has impregnated into the inner glove without reaching the interior surface thereof. On the other hand, with reference to the photograph of a cross-section of the glove of Comparative Example 1 shown in FIG. 4 (*b*), there is not a region of high whiteness as described above. In other words, in the glove of Comparative Example 1, the hot-melt adhesive does not remain in the inner glove and reaches the interior surface of the inner glove. These results indicate that the hot-melt adhesive could be prevented from reaching the interior surface of the inner glove by cooling and pressurizing the bonding portion to thereby bond the inner glove and the outer glove together. It should be noted that in FIGS. 4 (*a*) and (*b*), black portions above the coating layer 2*b* and below the inner glove 1 are background and not parts of the glove.

More specifically, from comparisons between Examples 1 to 3, Examples 1 and 2, of which pressure applied upon cooling and pressurizing the bonding portions was, respectively 0.53 $g/mm^2$ and 0.26 $g/mm^2$, were superior in peeling strength to Example 3 of which pressure applied was 1.06 $g/mm^2$. These results suggest that the pressure applied upon cooling and pressurizing the bonding portion is more preferably at least 0.2 $g/mm^2$ and no greater than 1 $g/mm^2$.

Furthermore, from a comparison between Examples 1 and 4, Example 1 which did not involve the pressurization upon heating of the hot-melt adhesive was superior in peeling strength to Example 4 which involved the pressurization. This suggests that it is preferred not to pressurize upon heating the hot-melt adhesive.

As described above, the glove of the present invention gives little unpleasant sensation such as roughness and is superior in peeling strength. Therefore, the glove can preferably be used as, for example, a glove used in construction works and operations in cold regions.

EXPLANATION OF THE REFERENCE SYMBOLS

1 Inner glove
2 Outer glove
2*a* Base
2*b* Coating layer
3 Hot-melt adhesive

The invention claimed is:

1. A glove comprising:

an inner glove that is knitted from a fiber yarn;

an outer glove that covers an outer side of the inner glove; and a hot-melt adhesive that is interposed partially between the inner glove and the outer glove which are layered, wherein the outer glove comprises a base that is knitted from a fiber yarn and a coating layer that is layered on an outer face of the base and composed of a rubber or a resin as a principal component, and the inner glove and the outer glove are bonded together by first heating, without inflating the outer glove, the hot-melt adhesive applied onto a bonding portion on the inner glove or the outer glove and then simultaneously cooling and pressurizing the bonding portion at a pressure of at least 0.15 $g/mm^2$ and no greater than 1.1 $g/mm^2$.

2. The glove according to claim 1, wherein the inner glove is a knitted product.

3. The glove according to claim 2, wherein the inner glove is seamless.

4. The glove according to claim 1, wherein a cooling temperature during the cooling and pressurizing of the bonding portion is no higher than a softening point of the hot-melt adhesive.

5. The glove according to claim 1, wherein the bonding portion is provided in fingertip regions on a palm side of first to fifth fingers and in at least one of border regions between a palm and the first to fifth fingers.

6. A manufacturing method of a glove which comprises:

an inner glove that is knitted from a fiber yarn;

an outer glove that covers an outer side of the inner glove; and a hot-melt adhesive that is interposed partially between the inner glove and the outer glove which are layered, wherein the outer glove comprises a base that is knitted from a fiber yarn and a coating layer that is layered on an outer face of the base and composed of a rubber or a resin as a principal component, the manufacturing method comprising:

applying the hot-melt adhesive onto a bonding portion on an outer face of the inner glove;

covering with the outer glove an outer side of the inner glove following the applying;

heating the hot-melt adhesive, without inflating the outer glove, after the covering; and simultaneously cooling and pressurizing, at a pressure of at least 0.15 $g/mm^2$ and no greater than 1.1 $g/mm^2$, the bonding portion of the inner glove and the outer glove after the heating.

7. The glove according to claim 1, wherein a portion of the inner glove is in contact with a portion of the outer glove.

8. The manufacturing method of a glove according to claim 6, wherein a portion of the inner glove is in contact with a portion of the outer glove.

* * * * *